US006889770B2

(12) United States Patent
Qvam et al.

(10) Patent No.: US 6,889,770 B2
(45) Date of Patent: May 10, 2005

(54) METHOD FOR THERMALLY PROTECTING SUBSEA INSTALLATIONS, AND APPARATUS FOR IMPLEMENTING SUCH THERMAL PROTECTION

(75) Inventors: Helge Andreas Qvam, Oslo (NO); Patrice Augilera, Hvalstad (NO); Steinar Hestetun, Asker (NO)

(73) Assignee: ABB Offshore Systems AS, Billingstad (NO)

( * ) Notice: Subject to any disclaimer, the term of this patent is extended or adjusted under 35 U.S.C. 154(b) by 93 days.

(21) Appl. No.: 10/203,498

(22) PCT Filed: Feb. 9, 2001

(86) PCT No.: PCT/NO01/00047

§ 371 (c)(1),
(2), (4) Date: Aug. 9, 2002

(87) PCT Pub. No.: WO01/63088

PCT Pub. Date: Aug. 30, 2001

(65) Prior Publication Data

US 2003/0010499 A1 Jan. 16, 2003

(30) Foreign Application Priority Data

Feb. 18, 2000 (NO) ..... 20000832

(51) Int. Cl.[7] ..... E21B 29/12
(52) U.S. Cl. ..... 166/356; 166/368; 166/75.13
(58) Field of Search ..... 166/75.13, 350, 166/368, 335, 356

(56) References Cited

U.S. PATENT DOCUMENTS

| | | | | |
|---|---|---|---|---|
| 3,063,500 A | | 11/1962 | Logan | |
| 3,556,218 A | * | 1/1971 | Talley et al. | 166/265 |
| 3,589,133 A | * | 6/1971 | Lowd et al. | 405/204 |
| 3,592,263 A | * | 7/1971 | Nelson | 166/356 |
| 3,703,207 A | * | 11/1972 | Horton | 166/337 |
| 3,742,985 A | * | 7/1973 | Rubenstein | 138/141 |
| 3,866,676 A | * | 2/1975 | Burns | 166/363 |
| 3,882,937 A | * | 5/1975 | Robinson | 166/267 |
| 4,258,794 A | | 3/1981 | Sizer et al. | |
| 4,273,472 A | * | 6/1981 | Piazza et al. | 405/211 |
| 4,452,312 A | * | 6/1984 | Roblin | 166/339 |
| 4,558,744 A | * | 12/1985 | Gibb | 166/335 |
| 4,715,439 A | * | 12/1987 | Fleming | 166/68 |
| 4,790,375 A | * | 12/1988 | Bridges et al. | 166/60 |
| 4,919,210 A | * | 4/1990 | Schaefer, Jr. | 166/356 |
| 5,176,471 A | * | 1/1993 | Frafjord et al. | 405/211 |
| 5,259,458 A | * | 11/1993 | Schaefer et al. | 166/335 |
| 5,795,102 A | * | 8/1998 | Corbishley | 405/171 |
| 6,009,940 A | | 1/2000 | Eck et al. | |
| 6,365,268 B1 | * | 4/2002 | Williams et al. | 428/327 |
| 6,415,868 B1 | * | 7/2002 | Janoff et al. | 166/368 |
| 6,520,261 B1 | * | 2/2003 | Janoff et al. | 166/350 |

FOREIGN PATENT DOCUMENTS

| | | |
|---|---|---|
| GB | 2 299 845 A | 10/1996 |
| NO | 901658 | 4/1990 |

* cited by examiner

*Primary Examiner*—Robert E. Pezzuto
*Assistant Examiner*—Thomas A Beach
(74) *Attorney, Agent, or Firm*—Cohen, Pontani, Lieberman & Pavane

(57) ABSTRACT

Method for protecting subsea installations against cooling which leads to hydrate formation, in particular during production halts. This is achieved by thermally isolating portions of the installation (1) against the surrounding water (2), and particularly by completely encompassing the subsea installation (1) by means of a cap (3) which seals against the surrounding water (2). The cap (3) comprises several elements of which each separately can be exposed to cooling and internal hydrate formation. The invention also comprises a thermally isolating apparatus, adapted for protecting subsea installations (1) against cooling, which involves a risk for hydrate formation. An apparatus (3, 9) for implementing the method comprises a relatively tight-fitting cap (3) which encompasses at least two of the elements to be protected from cooling. Thus, the water inside the cap (3) is kept separately from the surrounding water (2) and evenly distribute the heat energy present under the cap (3) to all the elements encompassed by the cap.

20 Claims, 2 Drawing Sheets

METHOD FOR THERMALLY PROTECTING SUBSEA INSTALLATIONS, AND APPARATUS FOR IMPLEMENTING SUCH THERMAL PROTECTION

PRIORITY CLAIM

This is a U.S. national stage of application No. PCT/NO01/00047, filed on Feb. 09, 2001. Priority is claimed on that application and on the following application(s): Country: Norway, Application No.: 20000832, Filed: Feb. 18, 2000.

The present invention relates to a method for protecting subsea installations as well as an apparatus or assembly for implementing such protection, and in particular thermal protection of such installations, where oil, gas or mixtures of various fluids comprising hydrocarbons, flow through subsea pipes or pipelines.

In connection with subsea oil and gas wells it has been known for a long time that there is a problem with respect to the oil or gas product during temporary interruption of the production, will be easily converted into hydrate that will clog up pipe connections.

This problem exists in all pipes carrying hydrocarbons irrespective of dimensions, and in order to improve these conditions, steps have been taken to insulate each individual pipe, both in manifolds and single pipes or tubes.

By applying thermal insulation to each individual pipe, one has to some extent achieved what is desired, namely that the surrounding water will need a longer time for cooling down pipes in which the production is much reduced or has been completely stopped. Thus, what is obtained is that it takes a little longer time before a lower temperature is reached, at which there is a risk of hydrate formation in the pipe.

For this reason one has often made a quite comprehensive and time-consuming and thus expensive work operation in order to insulate all pipes in such installations. It has been particularly time-comsuming to insulate each individual pipe in a manifold. Below follows in summary an overview of the work operation effected, so as to illustrate the complexity thereof:

First all the pipes in the manifold have been welded together into a unit. In this one has had to provide for a certain minimum spacing between two adjacent pipes so as to obtain sufficient space for the insulation. Already this has increased the volume of the manifold beyond that which otherwise would have been required.

The whole manifold with all pipe connections have been pressure tested.

The manifold is subdivided into somewhat smaller units so that each of these will fit into the space within a vulcanizing oven.

Each individual pipe is provided with vulcanizable rubber tapes.

The sections are individually put into the vulcanizing oven and heated until vulcanization takes place.

The units are taken out of the oven.

Each unit must be cooled and then welding is done again, possibly at new joints, so as to obtain an assembled unit.

A new pressure testing must be effected in order to check the new weld joints.

Bandaging and sealing of the insulation across the weld joints is performed.

Only upon sucsessful performing of this whole procedure, the manifold as a whole is ready for installation.

In addition to the fact that the procedure referred to, is time-consuming, expensive and requires high expert skill, the result will not be fully convincing. At production interruptions of longer duration, the cold surrounding water will by and by cool the metallic pipe irrespective of how good insulation that is applied. For example a temperature decrease with hydrate formation, i.e. a temperature as high as +20° C., can be reached in a time of about 1 hour.

In U.S. Pat. No. 3,504,741 (C.O. Baker et al.) it has been proposed to arrange a heat exchanger within a large production satellite, but this solution requires the drilling of an extra hot water well, with the complications and expenses involved thereby. This solution frequently cannot be resorted to in actual practice, since a hot water well can be established only at very few locations. Nor does the publication mention any insulation, which is a very important feature of the present invention. Besides it appears from this publication that several pipes are positioned outside the satellite and thereby will not be heated.

The present invention aims at providing a thermal insulation being inexpensive in production for all pipes and valves, and in particular inexpensive for pipes in manifolds where the pipes are running close to each other. The invention makes it possible to arrange the pipes in the manifold closely adjacent to each other, so that the manifold will be of smaller size and thereby lighter; the work operation of insulating each individual pipe is avoided and still there will be obtained a far better thermal protection, so that it will take many times longer time before a pipe upon interruption of the production, is cooled down to a hydrate-forming temperature.

The invention also leads to a number of other advantages. Among other things the assembly will protect the installation, for example against overtrawling; and the invention leads to a far simpler maintenance, since the thermally insulating apparatus or assembly can easily be removed for maintenance and inspection.

Moreover there is no need of any extra hot water well, as described in U.S. Pat. No. 3,504,741.

All this is obtained with a method and a thermal insulation in accordance with the appended claims.

The very main idea of the invention may be said to be that a certain amount of water surrounding several components each of which separately involves a risk of production interruption with subsequent cooling and formation of hydrate, is encompassed within a closed or almost closed cap or cover, so that the amount of water is heated and is utilized as a heat battery or heat reservoir for all components within the cap.

In order to obtain a better understanding of the invention, reference is made to the following detailed description of an exemplary embodiment, as well as the drawings, wherein.

Figure 1:
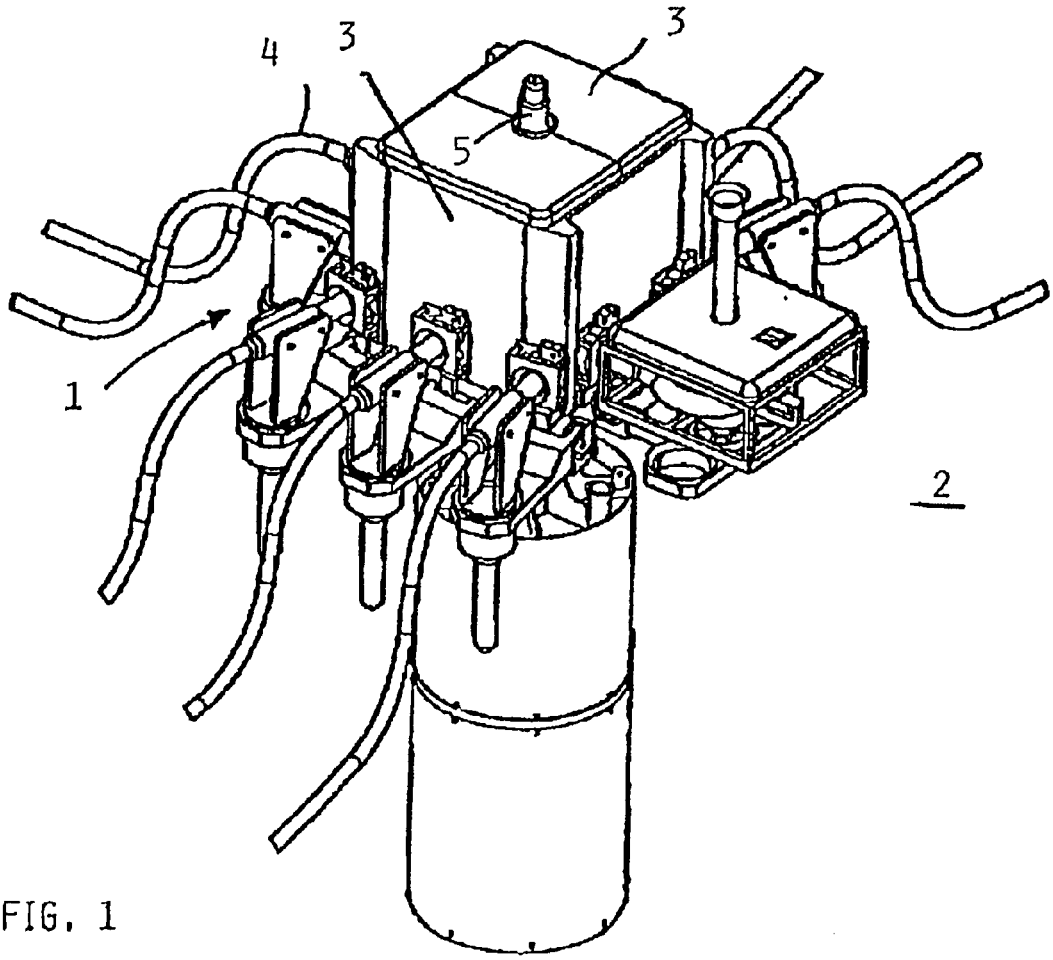
FIG. 1 shows a manifold located in a subsea position at the operation site and is provided with a "heat box" or cap according to the present invention.
Figure 4:
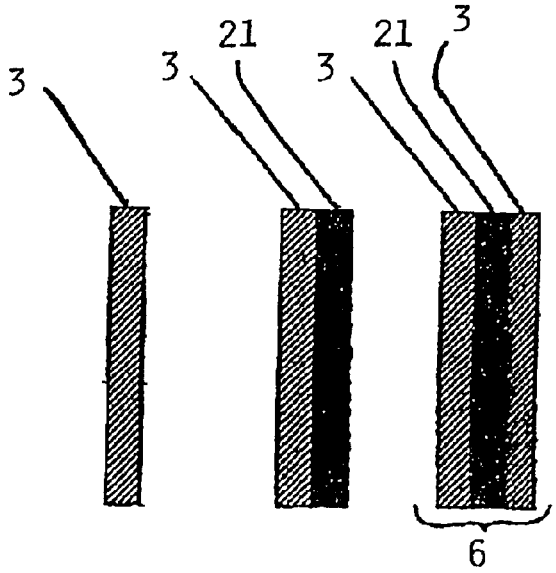
FIG. 4 shows a cross sectional view through different walls of a cap according to FIG. 2, a) completely made of insulating material, b) with insulation at only one side of the wall, and c) with insulation inside a shell of supporting material.
Figure 2:
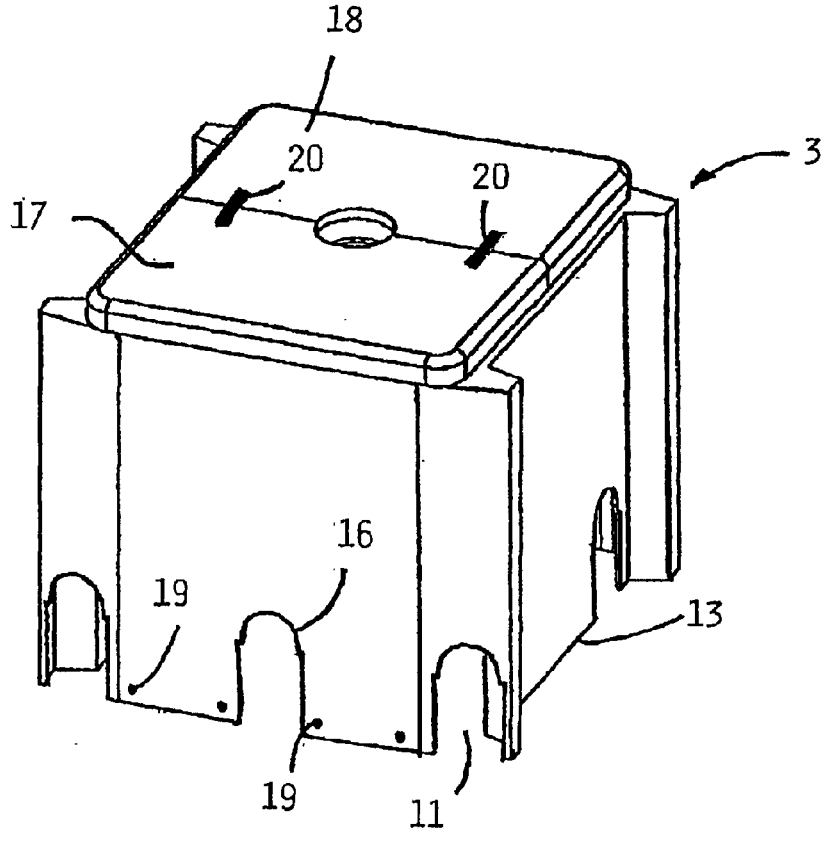
FIG. 2 shows a surrounding cap according to the present invention.
Figure 3:
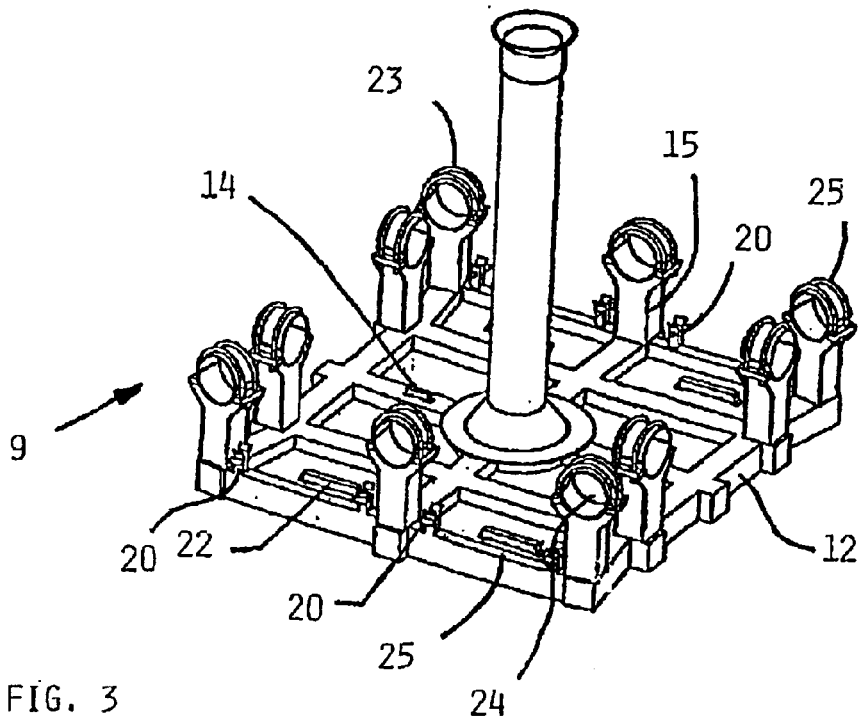
FIG. 3 shows a preferred base plate adapted to be assembled with the cap on/about the manifold.

It is to be noted that the figures of drawings only illustrate preferred embodiments not to be taken as limiting of the invention, which in contrast can be implemented in various manners.

As far as practical the same reference numerals have been used for all elements/details having the same function.

The scale of the drawings is not necessarily the same in all figures of drawings, nor in different directions in one and the same drawing.

The figures are only meant as illustrations of the principle, and some details may have been excluded in order not to make the drawings too cumbersome.

In the figures of drawings the oil/gas-producing installation 1 is shown submerged in the surrounding water 2. The parts of the installation 1 which should not be too much cooled, are located within a cap or cover 3.

It can be said that the main idea of the invention is to provide a tightly enclosing cap 3 or heat box around a subsea installation 1, for example a manifold, so as to encompass all the pipes to be insulated. Inside the cap generally water will then be confined so that this to a highest possible degree will be prevented from flowing out to the surroundings. Accordingly the volume of water being confined within the cap 3 will surround the manifold at all sides. This will secure that the temperature will be the same at all parts of the manifold. As long as production takes place in all manifold pipes the whole water volume within the cap accordingly will be heated by the pipes until thermal equilibrium is obtained, however, with a certain loss of heat from the manifold to the internal water and from the internal water through cap 3 out to the surrounding water 2, which has a far lower temperature.

As a consequence of this solution an interruption of the production in a single pipe or in a few pipes of the manifold, will not have any strong influence on the temperature as long as the production still takes place in one or more of the remaining pipes. Thus, these remaining pipes will contribute to maintaining the temperature of the water within cap 3, relatively high. Accordingly, each individual pipe in the manifold will not be dependent on its own production for maintaining the temperature, since all the pipes quite jointly will contribute to giving an increased temperature within the cap 3 or heat box.

This effect will be obtained with any cap 3 that is tightly sealing, because the water within the cap will be confined from the cooler water 2 outside the cap. The effect will be additionally strengthened if the cap 3 is made to be insulating, either by employing a material in the cap being by itself well insulating, or by insulating the whole or portions of the cap, for example by means of insulating layers 21 applied inside the cap 3. Additionally the cap 3 can also for example be of a sandwich construction with a best possible insulation 21 in the interspace between the walls, more or less in the manner of a so-called thermos flask.

In order to further improve the usefulness of the insulating cap, it can be provided with various auxiliary means for local heating, which can either be continuous or can take place by supplying heat at particularly critical points of time. Such supplied heat can be obtained in various different ways, for example by means of a small heating element 22 located within cap 3 or on the base plate 9. Such a heating element 22 can be supplied with electric energy, for example from the surface or can be in the form of a tube carrying a heated fluid in the form of a gas and/or a liquid. Another solution for supplying heat can be to provide an intake 23 and an outlet 24 at the cap 3, for example so that a heated liquid or a heated fluid can be slowly introduced through intake 23 in the cap, whereas cooled liquid/fluid is discharged from cap 3 through an outlet 24 for that purpose. Such intakes 23 and outlets 24 can of course be provided with suitable fittings and valves, and with this solution the liquid in the cap will be exchanged at an increased rate.

As regards sealing between liquid within the cap and liquid outside the cap, this can be more or less complete. In the simplest solutions the cap can be open downwardly all the way along its lower periphery being in engagement with the bottom or another base, and forms relatively good sealing against this. In another embodiment the cap can be divided into two parts, for example by having a lower bottom plate 9 provided with shorter or longer guide rods 15 or the like being adapted to fit into corresponding holes or openings 16 in the upper cap part 3. At the upper part 3 and the lower part (bottom part 9) the cap is formed in a complementary manner along the side edges 13,12 and if necessary provided with suitable seal elements, thus making it possible to obtain a very good sealing.

Even when one or more manifolds, one or more valves or other subsea installations 1 are to be protected by a common cap 3, and pipes 4,5 running in various directions, shall be extended through this cap 3, a very good sealing can be obtained by means of various mechanical solutions. For example the cap can be provided with vertically extending grooves 16 corresponding to all or the plurality of pipes to be extended through the cap 3, whereas the bottom plate 9 can be provided with corresponding wall parts or cap parts 15 reaching up to the pipe 4 and encloses, possibly supports this. Thereby it will be possible to lower the upper cap part 3 directly down onto the bottom plate 9 by means of a crane (not shown) and thereby be positioned and oriented so that the bottom plate 9 and the upper cap 3 slide together in a sealing manner. In possible gaps between the bottom plate 9 and the upper cap 3 there can be provided sealing elements 25 as know per se of a flexible type and moreover the bottom plate 9 and the cap 3 can be locked to each other by means of locking mechanisms 19,20 as known per se, possibly being able to be operated by a diver or by a ROV unit.

In the figures there is indicated a snap action lock comprising elastic, internal locking elements 20 located at several places on the bottom or base plate 9. These can be snapped in place and released by being operated through small openings 19; but other locking mechanisms of conventional type can also be employed.

Although the invention has been described above with reference to thermal insulation of one or more manifolds, there is of course nothing to prevent that the corresponding principle is employed for insulating other subsea installations or parts of these. Thus, the invention can be used for protecting pipes or pipe sections, valves or Christmas trees, and several different elements or units can be located within the same cap or cover.

In order to have a better control of the conditions at the bottom, a temperature sensor 14 can be located within the cap 3 and the measurement value generated can be read out at the sea surface. If the cap is provided with intakes 23 and outlets 24 for liquid, other liquids than water can also, at least temporarily, be employed when particular desirable properties are of interest.

The apparatus or assembly can be modified in various ways within the framework of the invention. Thus, the cap 3 can be split up into several parts, such as 17,18, which can be easily assembled into a unit. This can simplify the assembling in the case of installations having a complex shape. The material can be thermally insulating in itself, or insulation can be applied at the inside or at the outside.

Even if production should be interrupted in all pipe elements inside the cap, it will take much longer time before hydrate-forming temperatures are reached. The norm today in the best case is 12 hours. This invention can provide for one week or more before hydrate is formed. The water inside the cap will have a significant over-temperature when stop of production occurs. Accordingly, the warm water inside the cap will much delay the cooling, and the more the larger water volume is present, the better the insulation is, and the better sealing the cap provides for.

What is claimed is:

1. A method for protecting a subsea installation against cooling which leads to hydrate formation, in particular during interruption of production, by having parts of the installation (1) thermally insulated against the surrounding water (2), wherein the subsea installation (1) is completely or partially encompassed by a cap (3) which seals against the surrounding water (2), whereby the cap (3) encloses several elements which each separately can be subjected to internal hydrate formation, a bottom plate (9) is placed on a foundation (10) under water (2), the subsea installation (1) is placed on the bottom plate (9), the cap (3) is lowered onto the bottom plate (9) and is attached thereto; and wherein the cap (3) and the bottom plate (9) are attached to each other by fastener elements (19, 20).

2. The method according to claim 1, wherein the cap (3) is provided with a pressure resistant, thermal insulation (4) at its surface (5).

3. The method according to claim 1, wherein the cap (3) is designed as a sandwich shell structure (6) having double walls, and thermal insulation (4) is provided between the sandwich double wails (7, 8).

4. A thermally insulating assembly adapted to protect a subsea installation (1) against cooling which leads to a risk of hydrate formation, wherein the assembly (3, 9) comprises a relatively tightly enclosing cap (3) for surrounding at least two of the elements which it is desired to protect against cooling, so that the water within the cap (3) is kept separated from water (2) in the surroundings and distributes heat energy present under the cap (3) to all of the elements enclosed thereby, wherein the assembly further comprises a bottom plate (9) having side edges (12) which are shaped substantially to be complementary to the side edges (13) of the can (3), so that there is left room for required pipe and cable connections to the installation (1).

5. A thermally insulating assembly according to claim 4, additionally comprising at least one internally located temperature detector (14).

6. A thermally insulating assembly according to claim 4, wherein at least one of the bottom plate (9) and the cap (3) is provided with sealing elements (25) along the periphery thereof and at openings in the structure.

7. A thermally insulating assembly according to claim 4, wherein the cap (3) includes at least two separate cap components (16, 17, 18).

8. A thermally insulating assembly according to claim 7, wherein the cap components (16, 17, 18) are provided with fastening devices (19, 20) which can be joined in a detachable manner.

9. A thermally insulating assembly according to claim 4, further comprising at least one temperature detector (14) as well as at least one heating element (22).

10. A thermally insulating assembly according to claim 4, further comprising at least one intake (23) and at least one outlet (24) for fluid, so that the fluid inside the assembly can be exchanged.

11. A method for protecting a subsea installation against cooling which leads to hydrate formation, in particular during interruption of production, by having parts of the installation (1) thermally insulated against the surrounding water (2), wherein:

the subsea installation (1) is at least partially encompassed by a cap (3) which seals against the surrounding water (2), whereby said cap (3) encloses several elements which each separately can be subjected to internal hydrate formation, a bottom plate (9) is placed on a foundation (10) under water (2), the subsea installation (1) is placed on the bottom plate (9), the cap (3) is lowered onto the bottom plate (9) and is attached thereto, the cap (3) having an internal cavity (11) with such a shape and size as to make the cap (3) cover the installation, whereby the cap (3) and the bottom plate (9) have complementary shapes along the periphery and are located so as to fit sealingly to each other;

and wherein the cap (3) and the bottom plate (9) are attached to each other by fastener elements (19, 20).

12. A method according to claim 11, wherein the cap (3) is provided with a pressure resistant, thermal insulation (4) at its surface (5).

13. A method according to claim 11, wherein the cap (3) is designed as a sandwich shell structure (6) having double walls (7, 8) and that thermal insulation (4) is provided between the sandwich double walls.

14. A thermally insulating assembly adapted to protect subsea installations (1) against cooling which leads to a risk of hydrate formation, wherein the assembly (3, 9) comprises a relatively tightly enclosing cap (3) for surrounding at least two of the elements which it is desired to protect against cooling, so that the water within the cap (3) is kept separated from the water (2) in the surroundings and distributes the heat energy being present under the cap (3) to all the elements being enclosed thereby, and wherein said assembly additionally comprises at least one internally located temperature detector (14).

15. A thermally insulating assembly according to claim 14, wherein the assembly comprises a bottom plate (9) having side edges (12) which are shaped substantially to be complementary to the side edges (13) of the cap (3), so that there is left room for required pipe and cable connections to the installation (1).

16. A thermally insulating assembly according to claim 14, wherein at least one of the bottom plate (9) and the cap (3) is provided with sealing elements (25) along the periphery thereof and at openings in the structure.

17. A thermally insulating assembly according to claim 14, wherein the cap (3) includes at least two separate cap components (16, 17, 18).

18. A thermally insulating assembly according to claim 17, wherein the cap components (16, 17, 18) are provided with fastening devices (19, 20) which can be joined in a detachable manner.

19. A thermally insulating assembly according to claim 14, further comprising at least one heating element (22).

20. A thermally insulating assembly according to claim 13, further comprising at least one intake (23) and at least one outlet (24) for fluid, so that the fluid inside the assembly can be exchanged.

* * * * *

UNITED STATES PATENT AND TRADEMARK OFFICE

CERTIFICATE OF CORRECTION

PATENT NO. : 6,889,770 B2
APPLICATION NO. : 10/203498
DATED : May 10, 2005
INVENTOR(S) : Helge Andreas Qvam It is certified that error appears in the above-identified patent and that said Letters Patent is hereby corrected as shown below:

Insert Item (75) Inventors: Helge Andreas Qvam, Oslo (NO);
Patrice Aguilera, Hvalstad (NO);
Steinar Hestetun, Asker (NO)

Signed and Sealed this

Twelfth Day of December, 2006

JON W. DUDAS
*Director of the United States Patent and Trademark Office*